US009839937B1

(12) United States Patent
Lindelof et al.

(10) Patent No.: US 9,839,937 B1
(45) Date of Patent: Dec. 12, 2017

(54) METHOD OF MAKING A POWDER COATED PROTECTED PRONG FILE FASTENER

(71) Applicant: Smead Manufacturing Company, Hastings, MN (US)

(72) Inventors: Harold Peter Lindelof, Eden Prairie, MN (US); Marvin J. Halfen, Hastings, MN (US); David J. Gilbertson, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 379 days.

(21) Appl. No.: 14/338,791

(22) Filed: Jul. 23, 2014

Related U.S. Application Data

(63) Continuation of application No. 13/293,311, filed on Nov. 10, 2011, now abandoned.

(60) Provisional application No. 61/412,039, filed on Nov. 10, 2010.

(51) Int. Cl.
*B05D 1/06* (2006.01)
*B65H 20/20* (2006.01)

(52) U.S. Cl.
CPC ..... *B05D 1/06* (2013.01); *B65H 20/20* (2013.01)

(58) Field of Classification Search
None
See application file for complete search history.

(56) References Cited

U.S. PATENT DOCUMENTS

| | | | | |
|---|---|---|---|---|
| 1,978,569 | A | 5/1932 | Dayton | |
| 2,225,426 | A | 12/1940 | Aronson | |
| 2,477,417 | A | 7/1944 | Pitt | |
| 3,478,409 | A * | 11/1969 | Kline | B21J 15/02 156/91 |
| 3,824,869 | A * | 7/1974 | Murphy | F16H 55/30 474/156 |
| 3,896,528 | A | 7/1975 | Abeles | |
| 3,992,766 | A | 11/1976 | Field | |
| 4,269,530 | A | 5/1981 | Weber | |
| 4,437,781 | A | 3/1984 | Weihe et al. | |
| 4,519,504 | A | 5/1985 | Nausedas | |
| 4,656,051 | A * | 4/1987 | Wojcik | B05B 13/0221 118/630 |
| 4,869,613 | A | 9/1989 | Corey | |
| 4,902,192 | A | 2/1990 | Ziegler | |
| 5,037,228 | A | 8/1991 | Karlin | |
| 5,096,323 | A | 3/1992 | Walker | |
| 5,213,429 | A | 5/1993 | Johnson | |
| 5,236,226 | A | 8/1993 | Sheffield | |
| 5,257,870 | A | 11/1993 | Bennett et al. | |
| 5,379,880 | A * | 1/1995 | Stone | B05B 13/0264 198/389 |
| 5,456,570 | A | 10/1995 | Davis et al. | |
| 5,593,242 | A | 1/1997 | Mathias | |
| 5,641,234 | A * | 6/1997 | Blumberg | B42F 13/06 402/14 |

(Continued)

*Primary Examiner* — Michael P Rodriguez
(74) *Attorney, Agent, or Firm* — Altera Law Group, LLC

(57) ABSTRACT

A prong style file fastener, and method of manufacturer, is disclosed which has a protective element to prevent damage to paper documents and personal injury. In one embodiment, the prongs of the fastener are covered with a powder coating which is melted thereon. In the case of the powdercoat covering, the production line uses a cam drive sprocket retractor system to release the line onto a takeup.

7 Claims, 14 Drawing Sheets

(56) References Cited

U.S. PATENT DOCUMENTS

| | | | | |
|---|---|---|---|---|
| 5,711,192 | A | 1/1998 | Vasilantone | |
| 5,785,444 | A | 7/1998 | Matsuura | |
| 5,862,579 | A | 1/1999 | Blumberg | |
| 6,168,337 | B1 | 1/2001 | Adams | |
| 6,565,277 | B1 | 5/2003 | Huang | |
| 8,746,314 | B1 * | 6/2014 | Lindelof | B29C 63/0069 156/516 |
| 8,747,588 | B1 * | 6/2014 | Lindelof | B29C 63/42 156/84 |
| 9,114,597 | B1 * | 8/2015 | Lindelof | B29C 63/0069 |
| 2010/0306988 | A1 | 12/2010 | Ziegler | |

* cited by examiner

METHOD OF MAKING A POWDER COATED PROTECTED PRONG FILE FASTENER

BACKGROUND

Field of the Disclosure

The present invention is directed to the field of paper document management, and more particularly to file fasteners having bendable prongs.

Description of the Related Art

Paper fasteners have been used for decades to bind paper documents into file folders. They are typically formed from a base plate with two orthogonal prongs extending from the ends of the base plate and which are themselves bendable.

In the most prevalent configuration, the fastener also includes a compressor plate which is used at the end of the prongs to provide a secure lock on the prongs.

An early example of such a binder is found in U.S. Pat. No. 1,978,569 to Dayton dating back to 1934. For 75+ years, this has remained the dominate form of prong binder such as shown in the commercial product. Modifications of the concept such as U.S. Pat. No. 2,477,417 to Pitt worked with the compressor concept but the basic metal base two prong bendable binder is still the standard of the industry today. Even in 1992, patents were being granted on variations of the same product which suffers from the same defects as the original product (see U.S. Pat. No. 5,096,323 to Walker).

These prior art devices have at least two serious deficiencies. First, they have sharp metal edges which shear the papers they are intended to bind and second, these same sharp edges can cause injuries.

A solution to these problems would be to dull or roll (coin) the edges. This does not seem to work at least with respect to the first problem. The mere nature of metal edges, dull or not, causes papers to become detached by ripping or shearing. Use of plastic prongs has likewise not worked well. The plastic is either too elastic or too rigid which causes cracks and failures.

The present invention provides multiple solutions to this dilemma.

BRIEF SUMMARY

A protected pronged file fastener is disclosed having a longitudinal base element having first and second ends, a pair of prongs each extending from each end of the base element, said prongs being bendably attached thereto, and a non-metallic sheath overcoating covering a substantial portion of each prong.

The fastener may also has a sheath of flexible tubular member heat shrunk on the prongs.

The fastener may also have prongs and tips, the prongs being tapered from the tip to a point between the tip and the end connect to the base.

The fastener may also have prongs that include a tip and are tapered from the tip to the base.

There is also a method of making a protected file fastener having a pair of prongs having proximal and distal ends, comprising any of the steps of inserting a length of heat shrinkable tubing on the proximal end of the prong, engaging the tubing with a pair of jaws and driving the tubing on to the prong until an end thereof reaches the distal end of the prong, applying heat to the tubing.

The method may also include making electrostatically charged plurality of fasteners which are joined together in a line; spraying meltable powder coating onto the line from below; heat treating the line to melt the powder into an overcoating.

The method may also include a line of prong fasteners which include a sprocket drive at its beginning and take up end, further including the steps of on the take up end engaging the line on a sprocket drive having moveable sprockets; retracting the sprockets on the drive after the line has been rotated only a portion of a turn on the sprocket drive, so that the line is removable from the sprocket drive.

The method may also include the step of engaging the sprockets in a channel on a drive wheel, the channel being a cam and wherein the sprockets are retracted in response to the curvature of the cam.

There is also a protected pronged file fastener having a longitudinal base element having first and second ends; a pair of prongs one each extending from each end of the base element, said prongs being bendably attached thereto, and a non-metallic sheath powder coating melted on a substantial portion of each prong.

The summary provided is intended to help the reader understand some aspects of the invention. The scope of the invention is defined by the claims as read with the specification and cannot be determined by this summary.

DETAILED DESCRIPTION OF THE INVENTION

Pronged fasteners are used primarily to attach documents into folders. They provide the advantage over ringed binders in that they are very compact and can adapt to varying thicknesses of documents and remain compact.

All of the prior devices suffer from two severe defects. First, they have sharp metal edges which shear the papers they are intended to bind and second, these same sharp edges can cause injuries. Thus, there has been a long felt need to solve both of these problems in an economical way, without losing the functionality of the prior art devices. Despite decades of attempts to develop a suitable alternative which was economically feasible, until now, the solution has eluded the efforts of others.

The present invention solves both of the above mentioned problems as well as an additional problem (metal fatigue from repeated bending of metal tangs), while maintaining a cost effective solution.

In one embodiment the as shown in FIGS. 1, 2, 3A, 3B, 4, 5, 6 and 7, a two prong binder 10 is shown. The version shown is a "bonded" type, meaning it is self contained and can be affixed to a file folder without punching the folder. The bonding feature is known in the art such as in Smead® Manufacturing Company product part number 24600. It is also possible to use the inventive features herein with other mechanisms for attachment to files, but as punching holes for the prongs to pass and riveting the base. (Smead® product 35511 or 11537, all of the named product being hereby incorporated by reference.)

Figure 7:
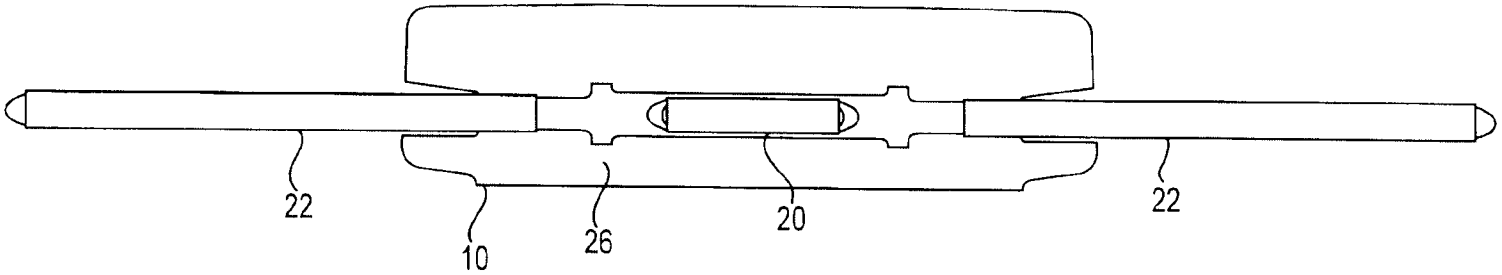
FIG. 7 is top plan view of the system in FIG. 4.

As seen most clearly in FIG. 7, binder 10 has a longitudinal base section 20, with bendable prongs 22 extending from both ends thereof. In this embodiment, the base is affixed to an fixation base 26 of fiber material which itself is then bonded to a file folder or the like, by adhesive.

Figure 1:
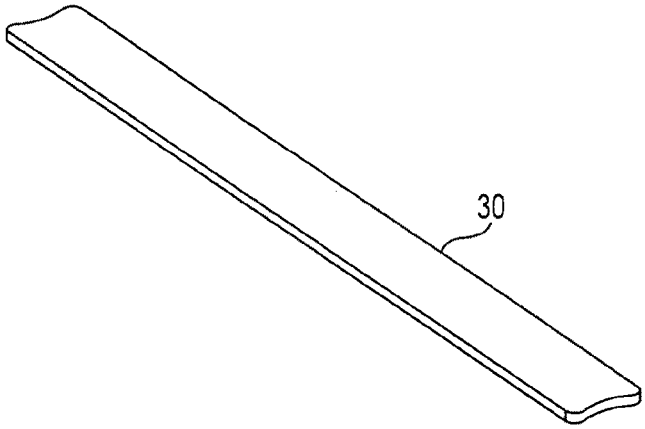
FIG. 1 illustrates a perspective view of a sheath.
Figure 2:
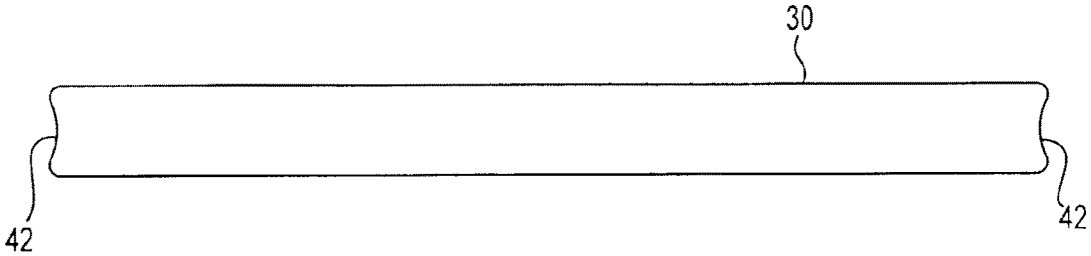
FIG. 2 is a plan view of the sheath in FIG. 1.

In this embodiment, the tang 22 is overcoated by a flexible material 30 which is shown alone in FIGS. 1 and 2. The preferred material is a heated shrinkable tubing of a type known in the art for electrical insulating applications such as 3M part IMCSN medium wall heat shrink tubing or similar products from Thermafix® product sold at www.shrink-shop.com. Such product typically have a 2:1 heat shrink ratio though other ratios may be acceptable.

Heat shrink tubing does not come flat as shown, but is supplied in a tubular format typically on long spools. The product is semi-rigid but not so rigid that it is easily inserted onto prong/tang 22 of the clasps 10. The method of manufacture which also forms a portion of this invention is detailed below.

To achieve the goals, of 1) safety against injury by laceration, 2) avoiding shearing of documents at their punch holes 3) metal fatigue caused by multiple bends to the metal tang and 4) creating wavy tangs from multiple bends in different places along its length as the document stack changes, by overcoating the tang with flexible non-shearing/cutting material, each of these problems is eliminated.

In particular, the tang 22 is fitted with a heat shrinkable sheath portion 30 which is then shrunk to engage the tang such that it cannot be removed. At the same time, the sheath protects both the user and the paper from cuts by occluding the sharp edges of the tang. Likewise, the bending radius of the tang is now reduced by virtue of the triple layered constructions (metal bounded by two layers of sheath). This prevents the tangs from kinking (becoming wavy and difficult for punched document papers to be inserted) and breaking from over bending. The increased bending radius is particularly helpful in avoiding damage to punched holes as there are no sharp bends in the tang at the point of contact with the paper at its weakest point (holes).

The prior art construction of the tang is not preferred for this new system. In the prior art, the tang has parallel sidewalls to its tip. In the preferred embodiment, the sidewalls 22*a-b* (see FIG. 6) are tapered so that they can accommodate insertion of the sheath 30 without snagging. This becomes important in high speed manufacturing because the sheath is not highly rigid, and if of low quality will not be perfectly cylindrical.

Figure 5:
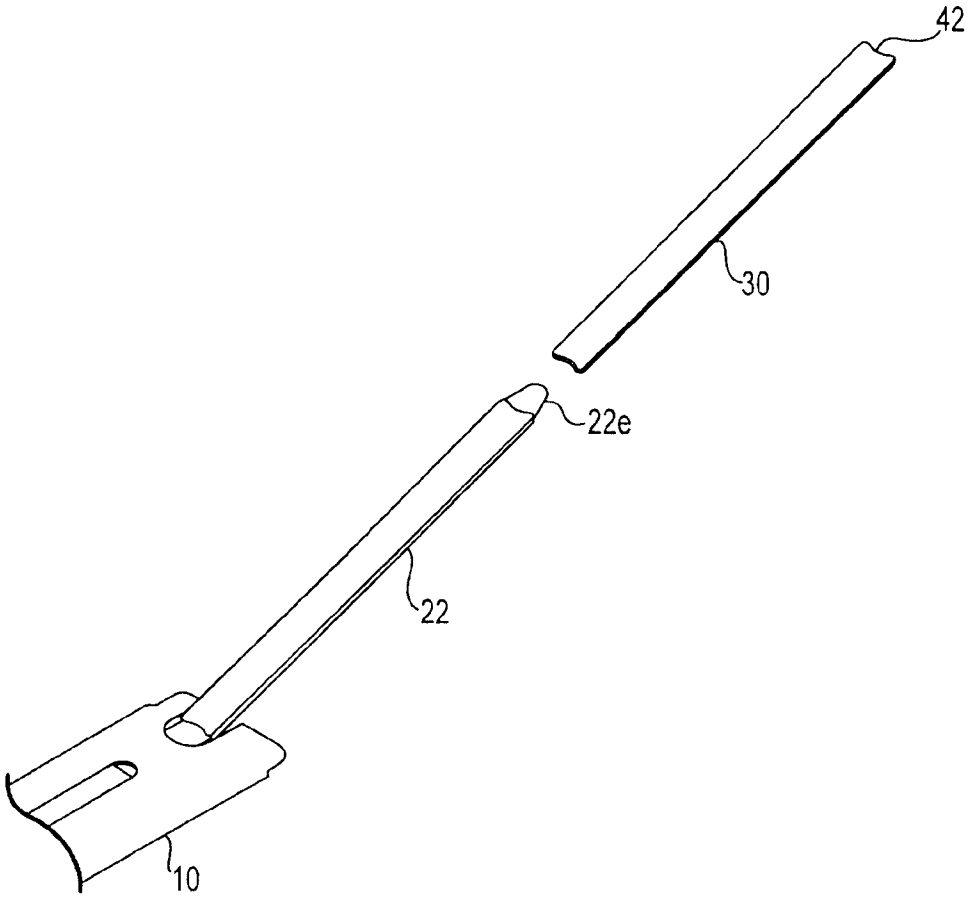
FIG. 5 is a fragmentary view of FIG. 4 with the sheath shown inserted and before insertion with a broad tip.
Figure 6:
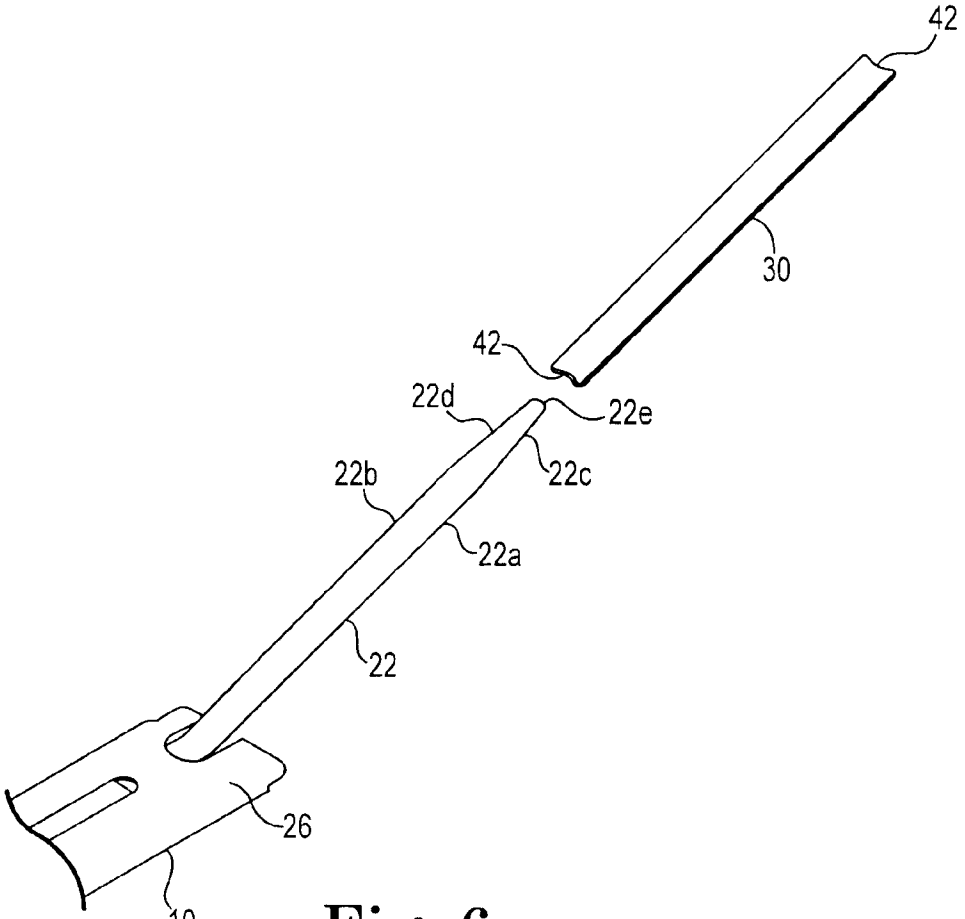
FIG. 6 is a view like FIG. 5 with the sheath before insertion with a narrow tip.

The tip in FIG. 5 is tapered, but in FIG. 6. is highly tapered for the same reasons as the body 22*a-b* is tapered. The taper 22*c-d* is more highly taped than the body 22*a-b*. This allows for easy insertion of the sheath, but does not result in an overly thin tang body which would degrade performance.

Figure 3A:
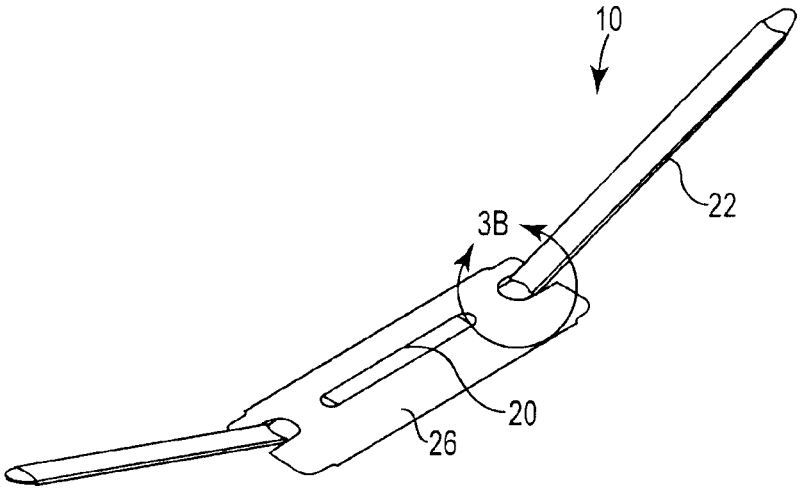
FIG. 3A is a perspective view of a prong clasp system according to one embodiment.
Figure 3B:
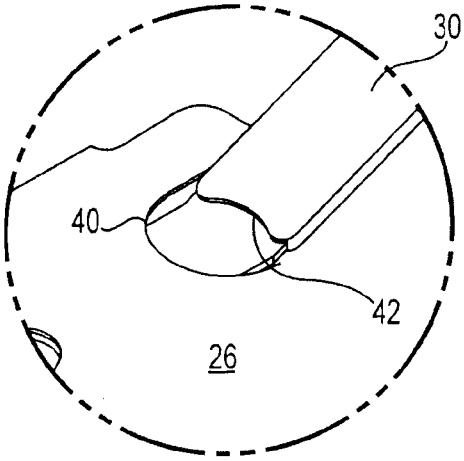
FIG. 3B is a close up fragmentary view of a portion of FIG. 3A.
Figure 4:
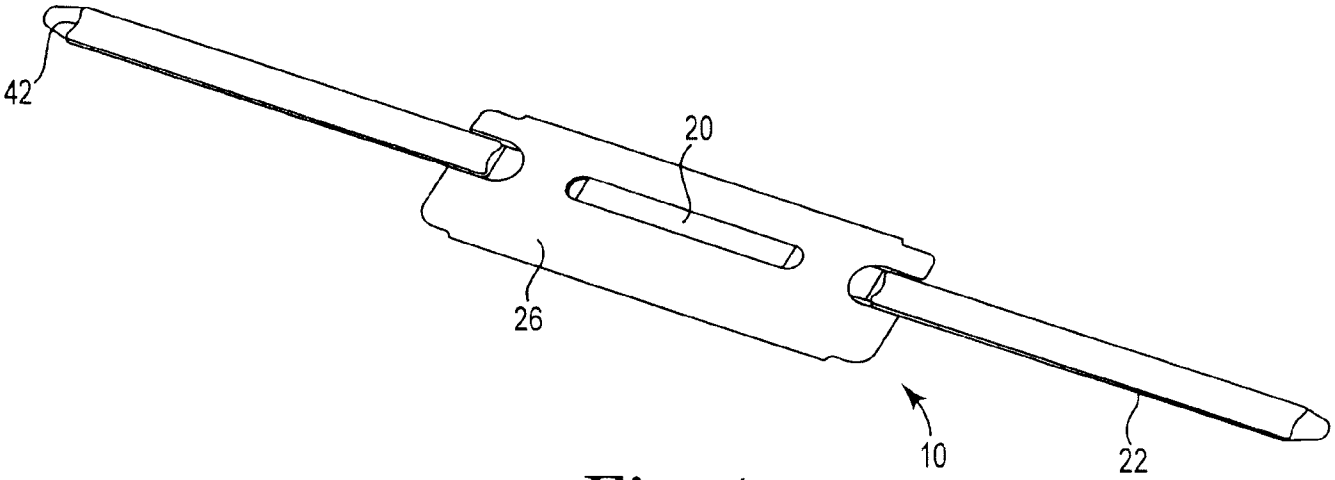
FIG. 4 is a perspective view of a clasp system.

The preferred terminations for the sheath 30 are as follows (see FIG. 3B: For the tip/distal end, the heat shrinkable sheath should terminate at a point on the top 22*e* where the total width (underlying base material+thickness of the sheath) is at least 10% less than the maximum width of the tang overcoated with heat shrinkable sheath/tubing. Alternatives would be 15%, 20%, 25% or more. The goal is to avoid snagging of the tip. By increasing the taper, the overcoating is less likely to snag. If the sheath 30 extends into the hole, the snagging risk is virtually eliminated.

At the proximal end the overcoating should preferably extend to contact or at least be adjacent to the base material 26 so that papers will not snag on their removal. The preferred extent would be close enough to the base that no single leaf of paper can fit therebetween.

When the heat shrinkable tubing is cut from a continuous spool, it can be simply cut orthogonally, or with a slight concavity 42. This can provide further resistance to snagging especially at the tip because the cut away portion (concavity) might otherwise cause slight bunching when shrinking.

Figure 8:
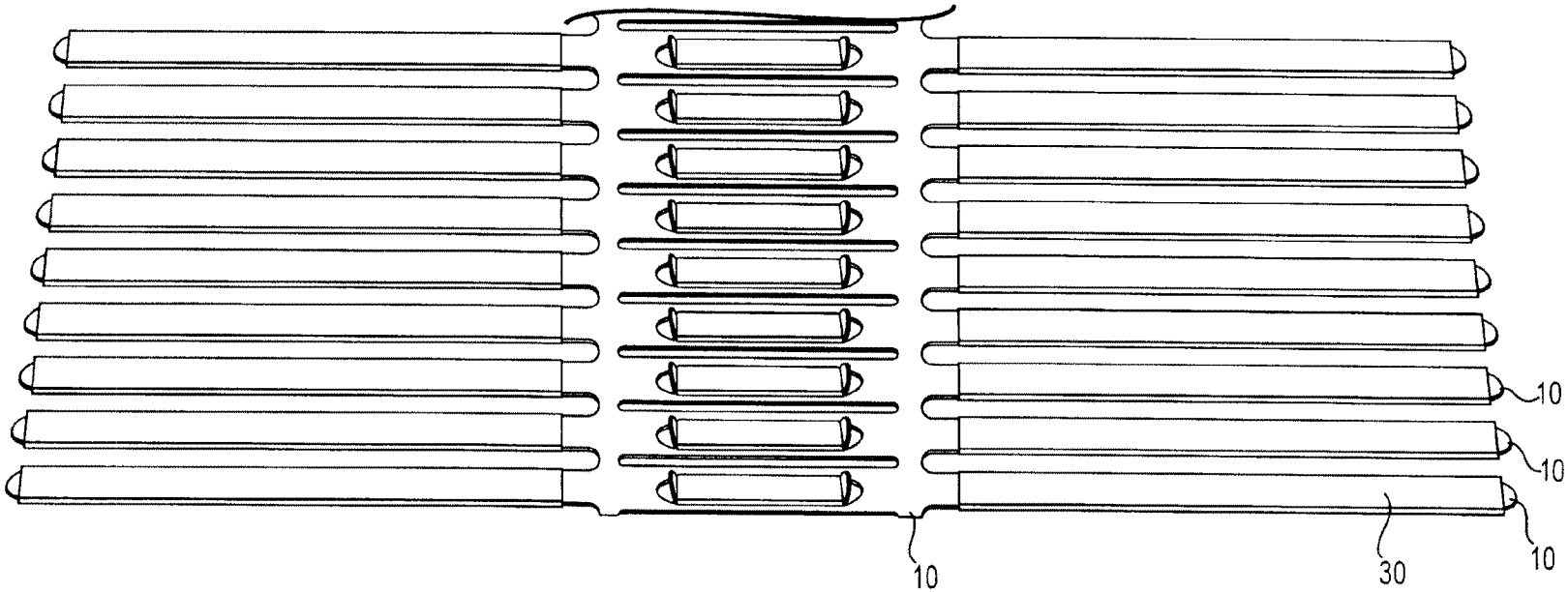
FIG. 8 is a perspective view of a plurality of prong clasps before cutting into separate clasps.

FIG. 8 illustrates a plurality of clasps 10 connected in a serial strip as produced by a punching machine. It is preferable to produce claps 10 in a continuous strip in order that they can be fitted with a sheath by automated machines.

Final assembly onto base material 26 and then applying on to a file folder can be done by methods well known in the art of clasps not having this protective sheath.

Divider Embodiment

The sheath solution is less preferred for the special configuration used where a folder has an internal divider section which also has pronged clasped. Such a divider is shown at www.smead.com as item 68025.

Internal divider sections are located between two outer covers (often with pronged clasps each). They are often called classification folders. While it is possible to use the sheath covered solution above, it is known to provide a clasp structure which straddles the top of the divider section as shown in FIGS. 11-12.

These differ from the claps shown in FIGS. 1-7 in that they are intended for divider boards which are inserted between front and back covers. As dividers, they have double sided clasps (four tangs per unit attached to the divider, one pair for each side of the divider board). Consequently, it is somewhat more difficult to use the sleeve solution in FIGS. 1-8 because the clasps are closer together, often the pairs of tangs are of different lengths and there is a bend that must be formed in the assembly for crimping to the board. For this reason the preferred overcoating is by application of a powdered material which is melted onto the tangs.

Figure 9:
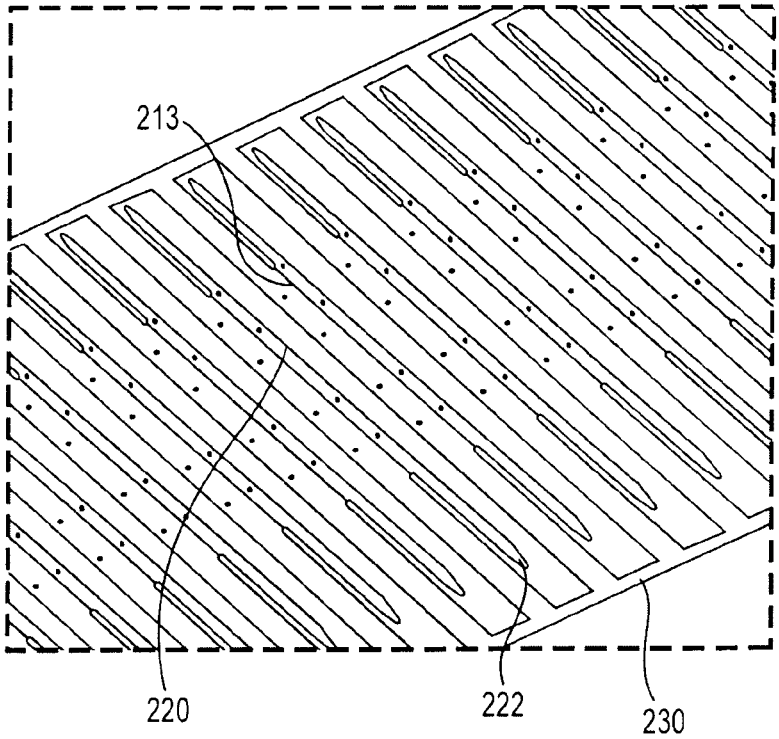
FIG. 9 is a perspective view of the plurality of divider style prong clasps in FIG. 8 illustrates.
Figure 10:
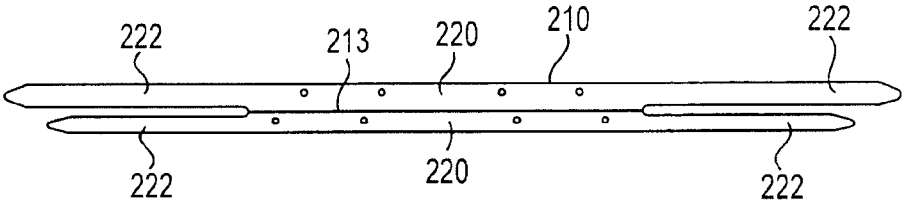
FIG. 10 is a top plan view of a single divider style prong clasp in FIG. 9.
Figure 11:
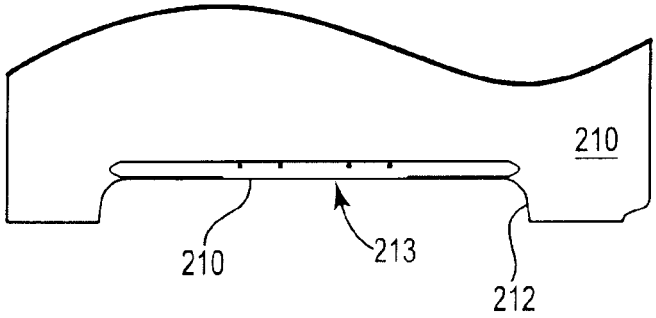
FIG. 11 a fragmentary plan view of a divider style prong clasp of FIG. 10 installed on one side of a divider.
Figure 12:
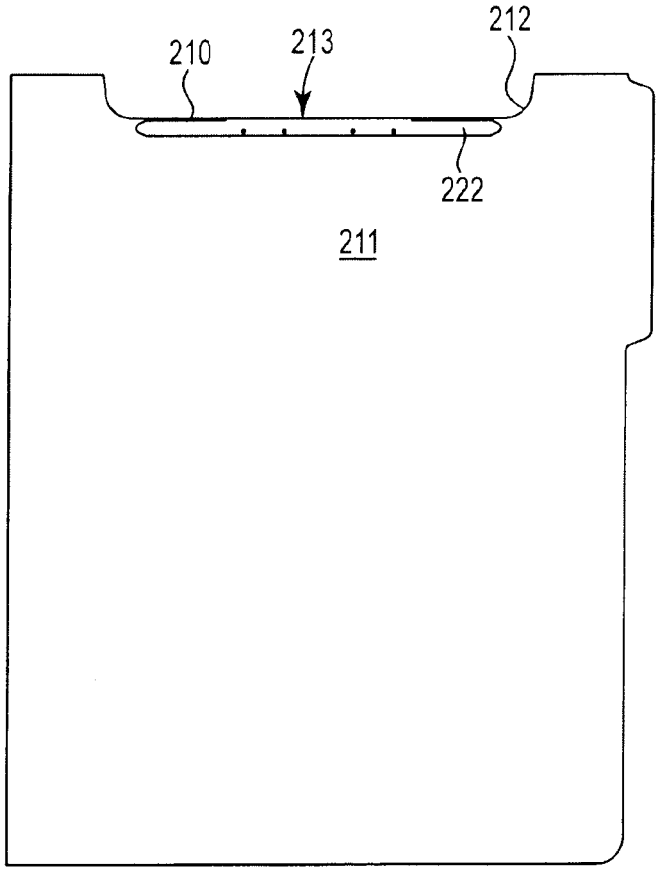
FIG. 12 is the other side of the divider shown in FIG. 11 shown in full view.

The divider 211 has two sides (FIG. 11 is a partial mirror image of FIG. 12). A recess is cut into the divider panel 211 such that the tangs 222 will be positioned appropriately for documents. Note: the clasp 210 straddles both sides of the divider by means of a link portion 213 between front and rear sides. FIGS. 9 and 10 also show these features.

FIG. 9 illustrates how a plurality of clasps 210 are chained together into a single spool.

In order to solve the problems of the prior art clasps as mentioned above, the framing connectors 230 (FIG. 9) needed to maintain the clasps on a roll. The connectors 230 will be cut out later.

The solution of the present invention in this embodiment is to overcoat the tangs and preferably the base section 220 with a protective coating which will remove all sharp edges and insure that the bending radius is increased, which will prevent kinking and metal fatigue.

Figure 13:
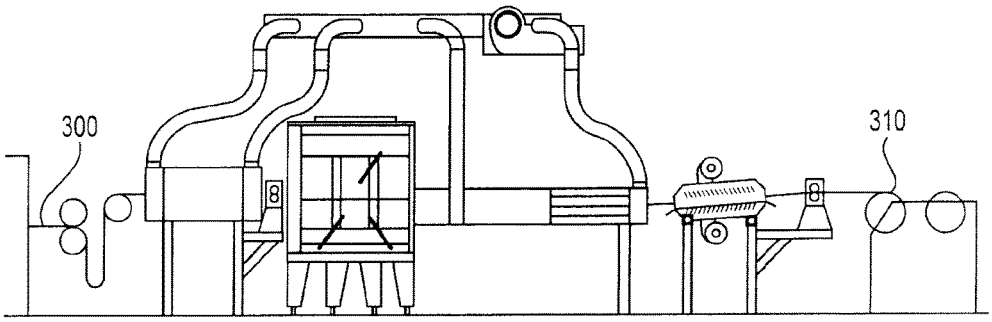
FIG. 13 is a schematic view of a powder coat production line.
Figure 14:
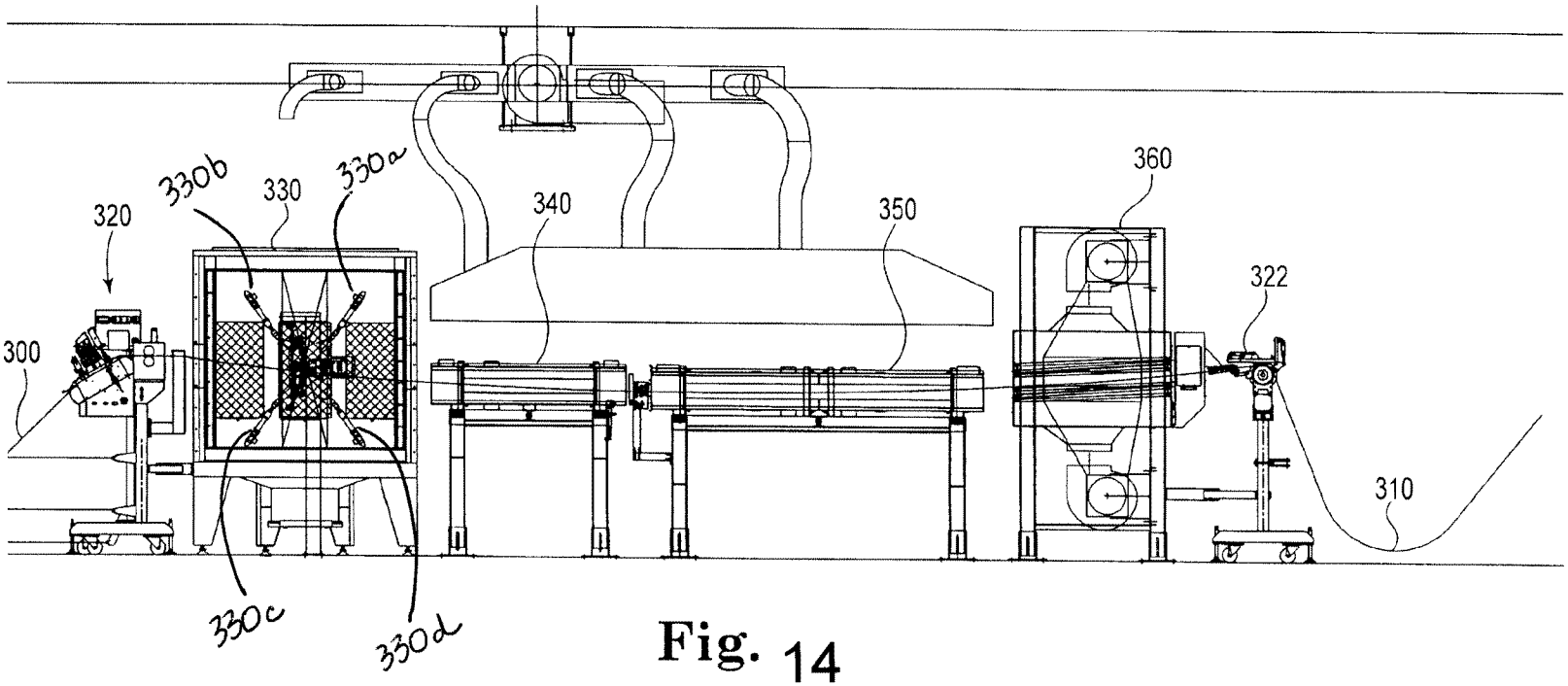
FIG. 14 is a close up view of a production line like FIG. 13.
Figure 15:
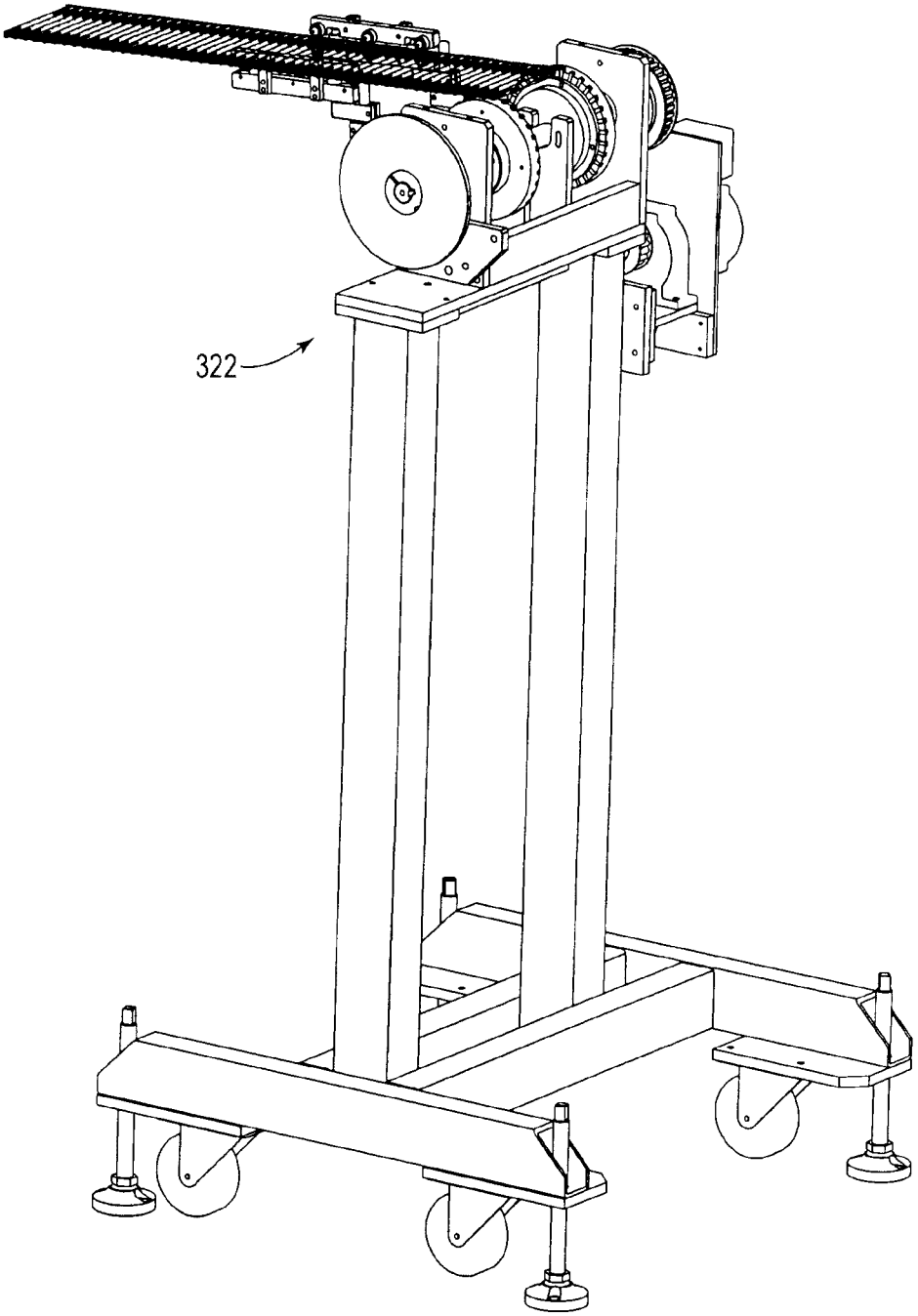
FIG. 15 is a close up perspective of a take up device for the production line.
Figure 16:
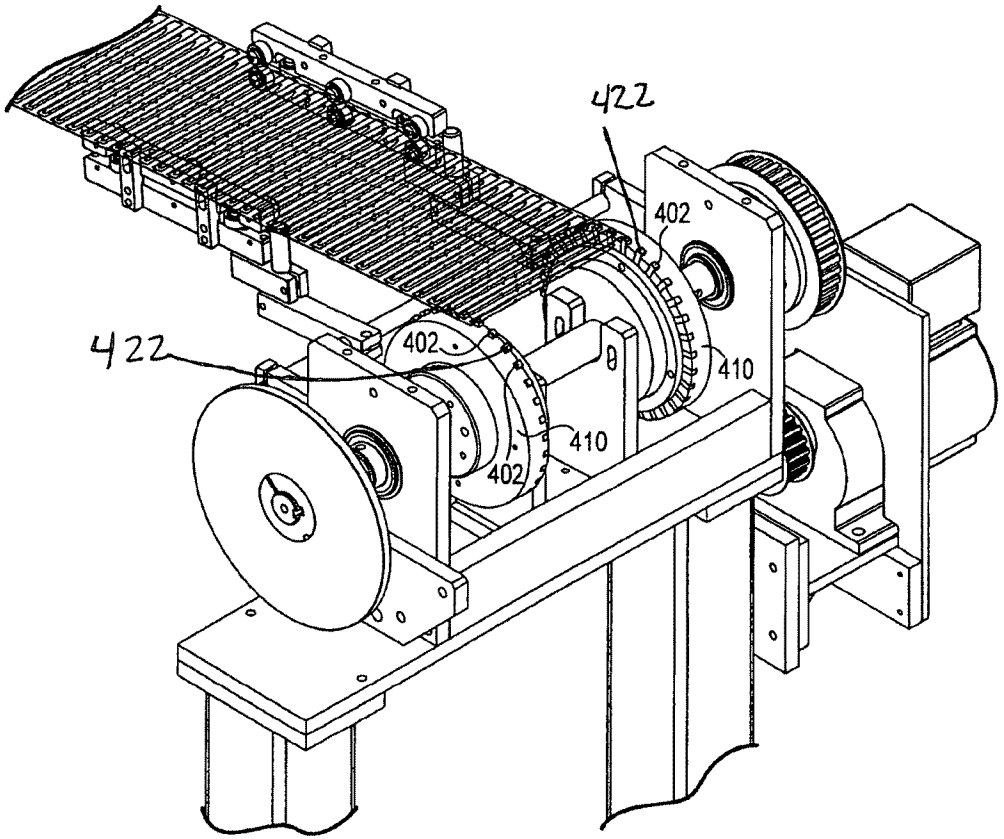
FIG. 16 is a close up perspective of the view in FIG. 15.
Figure 17:
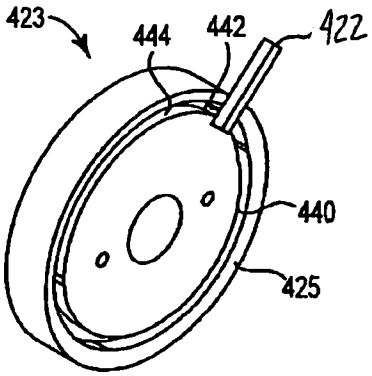
FIG. 17 is a close up fragmentary perspective of a cam drive tractor release system.
Figure 19:
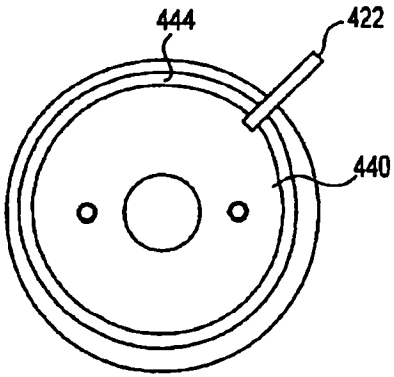
FIG. 19 is a front plan view of FIG. 17.
Figure 18:
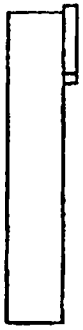
FIG. 18 is a side plan view of FIG. 17.

FIGS. 13 and 14 show a production line for purposes of overcoating the entire clasp stamping on roll with a plastic like powder coating.

In preparation for powder coating, it is desirable to bend the two clasps at their straddle point 213 so that the clasps are orthogonal to each other. This is shown is FIG. 9. If they are pre-bent 90 degrees, the flex required to bent a full 180 degrees (for attachment to the folder) will create less stress on the powder coat and it will be less likely to crack.

The pre-bending however creates difficulties in powder coating all of the prongs (there are typically 4 per unit), The powder coating is done electrostatically as well known in the art. The tangs 222, at a minimum are powder coated and heat treated to melt the powder into a continuous protect shield or coating around the sharp edges of the tangs. This gives them a rounded or radiussed edges that are both less likely to tear the paper at its holes and be safer for the user. Radiussing means that the sharp edges of the underlying tang material, (usually metal) is coated with the plastic-like melted powder coat which, because of its properties, including cohesion, creates curved or radiussed corners overcoating sharp corners.

The system of powder coating is shown generally in FIG. 13 and in details in FIG. 14. A supply spool of stamped clasps 300 as shown in FIG. 9 travels along the line to a take up reel 310, The claps are metal and electrostatically charged to attract the powder. Because powder coating is a complex mix of coating, time and speed of movement, it is important that the speed thru the line be tightly controlled. The first station is a tension station whose speed is electronically controlled with a like traction driver 322 on the other end of the line.

In FIG. 14 powder spray station 320 shows four sprayer nozzles 330*a* and 330*b* above the line and 330*c* and 330*d* below. The sprayers 330*a-d* are angled at generally 45 degrees of vertical. In practice we have found unexpectedly, the lower spay nozzles 330*c-d* are sufficient and even preferred to product an even power coat on the clasps especially in the critical surfaces (tangs) with the sharpest edges. It is also sufficient to prevent those portions which are ultimately going to be bent, to resist flaking the coating off. This appears to be the case because, the rising powder falls back down upon the upper surfaces so nozzles 330*a-b* are unnecessary and may even over load the surface with powder. Too much powder on one surface relative another is detrimental because it requires more heating time whilst the remaining surfaces may be overheated, melt or "cook" (burn).

The clasps travel thru a powder booth where plastic powder sprayed preferably only from underneath the line. This permits the bottom surfaces to be fully covered and the gravitational and electrostatic downward draw provides virtually identical coating on the upper side of the line. It also coats both sides of the 90 degree straddle bend.

From the powder booth 330, the line passes thru either a preheat oven 240 or simply a single oven 350 where the powder is evenly melted and then to a cooling station 360.

The final traction drive 322 must maintain the deflection of the line as it passes thru the oven so that it does not get too close or far from the heating elements.

Details of the take up tractor 322 are shown in FIGS. 15, 16, 17, 18, and 19. Tractor 322 has a series of pins 402 which engage openings in the clasp line. In order to get the line of clasps off the line and on a spool, the take up tractor wheels 410 include a plurality of pins 402 which are retracted as the wheels rotate toward take up. The objective is to remove the pins (sprockets) as the wheel rotates past top dead center (TDC) toward a 90 degree rotation. It can be seen that the pins are fully retracted at 90 degrees off TDC.

This retraction is accomplished by a fixed cam (FIG. 19) which is configured so that it detracts the pins from top dead center 423 to the 90 degree pong 425. The pins 422 have a cam follower pin 442 which extends generally orthogonally to the pin 422 and rides in a track 444 which receives the cam follower pin. Therefore, by rotation of the pin around the cam surfaces in the cam track 444, will move the pin in and out of the exterior surface and thus retracting the sprockets at the right time to allow the clasp line to be released from the tractor and then on to a take up spool.

In practice it looks like this: A take-up drive is provided for maintaining tension on a continuous production line, in this case, clasps are used. The drive has a known top dead center position. The production line having a longitudinal product line having a plurality of aperture along the length of the line, which here are gaps between the tangs. The driven then has a take-up drive wheel with a plurality of spaced apart pins slideable extending radially outwardly around the drive wheel, for engaging said plurality of apertures in the line. The pins are associated with a cam follower, which also could be considered part of the pin. A cam is associated with the wheel either in the track as shown or external to the wheel. The cam follower is responsive to the movement of the cam and the cam is configured to begin retracting the cam follower each pin as it passes the top dead center point. Preferably the cam is configured to fully retract said pins at a predetermined angle off top dead center, so that the line is thereby released from the take-up drive for further handling.

Other mechanical expedients are possible for retracting the pin besides using track 444. Preferably, the pin should follow a cam which is synchronized to withdraw the pin/sprocket past TDC. Another available solution is to withdraw the pin magnetically (solenoid action), without a cam by detecting the position of the pint relative to TDC and withdrawing when a predetermined angle off TDC has been reached.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A method of making a protected file fastener comprising the steps of:

a. electrostatically charging a plurality of file fasteners which are joined together in a line;
b. spraying meltable powder coating onto the line from below;
c. heat treating the line to melt the powder into an overcoating;
d. moving the line through the heat treatment at a predetermined speed;
e. driving a supply sprocket drive at the start of the line and a take-up sprocket drive at the end of the line, said take-up sprocket having a central rotational axis, and wherein the line is in synchronization to maintain said predetermined speed and wherein the line of file fasteners are engaged by retractable sprockets on the take-up drive, further including the step of:
   i. on the take up end drive engaging the line on a sprocket drive having retractable sprockets;
   ii. radially retracting the sprockets on the take-up drive after the line has been rotated only a portion of a turn on the sprocket drive, so that the sprockets are radially slideable toward and away from said axis, and wherein said line is removable from the sprocket drive.

2. The method of claim 1 including the step of slideably engaging the sprockets in a channel on a drive wheel, the channel including a cam and wherein the sprockets are retracted radially in response to the curvature of the cam.

3. The method of claim 2 wherein the step of slideably engaging said sprockets includes having each of said sprockets following a cam associated with the drive and beginning radial retraction of each sprocket as it passes through generally the top dead center location on the drive.

4. The method of claim 1 wherein the step of spraying a meltable coating includes applying powder coating to a bendable line of file fasteners, such that the coating will not flake off when bending, in a continuous spraying station having spray nozzles, comprising the steps of locating at least one nozzle upwardly generally at 45 degrees right relative to vertical, locating at least a second nozzle upwardly at generally 45 degrees left relative to vertical so that flow from the nozzles will intersect above the nozzles.

5. The method of claim 4 further including the step of locating a further nozzle above the path of the line of file fasteners aiming downwardly generally at 45 degrees right relative to vertical and locating a further nozzle above the path of the line of file fasteners aiming downwardly generally at 45 degrees left relative to vertical.

6. A method of making a protected file fastener comprising the steps of:

a. electrostatically charging a plurality of file fasteners which are joined together in a line;
b. spraying powder coating onto the line from below;
c. driving a plurality of file fasteners which are joined together in a line to form a drive belt;
d. moving the line through a coating station at a predetermined speed;
e. driving a supply sprocket drive at the start of the line and a take-up sprocket drive at the end of the line, said take-up sprocket having a central rotational axis, and wherein the line is in synchronization to maintain said predetermined speed and wherein the line of file fasteners are engaged by retractable sprockets on the take-up drive, further including the step of:
   i. on the take up end drive engaging the line on a sprocket drive having a plurality of radial slots and radially retractable sprockets;
   ii. radially retracting the sprockets within said radial slots on the take-up drive after the line has been rotated only a portion of a turn on the sprocket drive, so that the sprockets are radially slideable toward and away from said axis, and wherein said line is removable from the sprocket drive.

7. A method of making a protected file fastener comprising the steps of:

a. electrostatically charging a plurality of file fasteners which are joined together in a line;
b. spraying powder coating onto the line from below;
c. driving a plurality of fasteners which are joined together in a line to form their own drive belt;
d. moving the line through a coating station at a predetermined speed;
e. driving a supply sprocket drive at the start of the line and a take-up sprocket drive at the end of the line, said take-up sprocket having a central rotational axis, and wherein the line is in synchronization to maintain said predetermined speed and wherein the line of file fasteners are engaged by retractable sprockets on the take-up drive, further including the step of:
   i. on the take up end drive engaging the line on a sprocket drive having a plurality of radial slots and radially retractable sprockets;
   ii. using a cam follower which engages the sprockets, radially retracting the sprockets within said radial slots on the take-up drive after the line has been rotated only a portion of a turn on the sprocket drive, so that the sprockets are radially slideable toward and away from said axis, and wherein said line is removable from the sprocket drive.

* * * * *